US005115758A

United States Patent [19]

Suzuki et al.

[11] Patent Number: 5,115,758

[45] Date of Patent: May 26, 1992

[54] COATING APPARATUS FOR COATING A VEHICLE BODY

[75] Inventors: Hidenori Suzuki; Takahiro Mizune, both of Hiroshima, Japan

[73] Assignee: Mazda Motor Corporation, Hiroshima, Japan

[21] Appl. No.: 601,346

[22] Filed: Oct. 23, 1990

[30] Foreign Application Priority Data

Oct. 23, 1989 [JP] Japan ..... 1-275189
Sep. 28, 1990 [JP] Japan ..... 2-260250

[51] Int. Cl.[5] ..... B44D 1/094

[52] U.S. Cl. ..... 118/322; 118/621; 118/633; 118/642

[58] Field of Search ..... 118/58, 302, 620, 621, 118/622, 633, 641, 642, 643

[56] References Cited

U.S. PATENT DOCUMENTS

| | | | |
|---|---|---|---|
| 2,598,163 | 5/1952 | Halls | 118/416 |
| 2,657,666 | 11/1953 | Fowler | 118/322 |
| 3,902,453 | 9/1975 | Frische | 118/322 |
| 3,921,575 | 11/1975 | Ischii et al. | 118/322 |
| 4,009,301 | 2/1977 | Heckman et al. | 118/642 |
| 4,092,953 | 6/1978 | Waugh | 118/322 |
| 4,730,575 | 3/1988 | Jenkins | 118/612 |
| 4,849,598 | 7/1989 | Nozaki et al. | 118/642 |
| 4,908,231 | 3/1990 | Nelson et al. | 118/642 |

*Primary Examiner*—Tim Heitbrink
*Attorney, Agent, or Firm*—Fish & Richardson

[57] ABSTRACT

A baking oven is divided into a first baking oven and a second baking oven. A conveyor line is also divided into two sections, a first conveyor line section being so disposed as to pass through the first baking oven only, and a second conveyor line section being so disposed as to pass through the second baking oven only. A substrate is coated with a paint and then conveyed through the first baking oven while being so supported by a carrier with a rotating device and being rotated about its approximately horizontal axis extending in a longitudinal direction thereof with the rotating device. The rotation of the substrate is carried out at a speed which is high enough to prevent the paint coated from sagging due to gravity yet which is low enough so as to cause no sagging as a result of centrifugal force. After baking in the first baking oven, the substrate is then changed over in a position prior to the second baking oven from the carrier with the rotating device to the carrier without the rotating device, namely, from the first conveyor line section to the second conveyor line section and conveyed to the second baking oven wherein the substrate is further baked.

21 Claims, 7 Drawing Sheets

COATING APPARATUS FOR COATING A VEHICLE BODY

BACKGROUND OF THE INVENTION

1. Field of the Invention

The present invention relates to a coating apparatus.

2. Description of Related Art

A coating line for automotive vehicles generally comprises a coating step for coating vehicle bodies and so on with a paint and a baking step for baking and drying the paint coated on the vehicle bodies in the coating step. Further, when such a paint as, for example, a thermosetting paint is employed, the coating line is provided with a setting step between the coating step and the drying step, in which the paint coated thereon is allowed to be dried at an ambient temperature or at a temperature which is somewhat higher than the ambient temperature.

U.S. Pat. No. 4,874,639, U.S. patent application Ser. No. 323,237 now U.S. Pat. No. 4,919,977, and Japanese Patent Unexamined Publication (kokai) No. 178,871/1988 disclose a coating method in which vehicle bodies and so on are to be sprayed in the coating step with a paint in a film thickness thicker than a film thickness that causes sagging unless the coat formed on the vehicle bodies and so on is treated for preventing sagging and in which the vehicle bodies and so on are rotated at an approximately horizontal axis in a longitudinal direction of the body or the like. This coating method permits the paint to be coated thereon in a film thickness thicker than conventional coating methods could ever achieve, while preventing the coated paint from sagging. Hence, this coating method can provide highly improved flatness on the coat surface. In practically applying this coating method to the coating line for automotive vehicles, the coating method requires the use of such a carriage or carrier for conveying the vehicle bodies or the like through the coating line, as having the construction as described in the above-mentioned prior patent and patent applications. The carriage or carrier has a rotating device built thereon, which can rotate the vehicle body or the like with the coat of the paint formed thereon, while being rotated about its approximately horizontal axis in the longitudinal direction thereof. This kind of carriage or carrier will sometimes be referred to as a rotating carriage or carrier in the description of this specification which follows. The vehicle body and other coating substrate is coated or sprayed with a paint in a film thickness than its sagging limit in the coating step and then conveyed by the coating carriage into the drying step. It should be noted that the terms "sagging limit" and so related to this expression is intended herein to mean a film thickness thicker than a thickness of the paint that sags when a coat of the paint is stayed for a predetermined period of time as it was sprayed. The substrate coated with the paint in such a thick coat thickness may be transferred to the setting step in accordance with the kind of the paint. The coated substrate is then conveyed by the rotating carriage through a baking oven, thereby baking and drying the coat on the substrate. It is further to be noted that approximately 35 minutes are required for baking and drying the vehicle body and so on for one automotive vehicle as well as for heating the automotive vehicle body itself. Hence, on an industrial scale, an oven for baking and drying the vehicle bodies and so on should become extremely longer. Further, a great number of rotating carriages is required. It should be noted herein that the carriage or carrier with the rotating device as described in the prior patent and patent application is much more expensive than usual carriages or carriers. This means that a vast amount of money is required for investment and at the same time such a vast amount of investment naturally leads to a rise in cost. Therefore, further improvements have been demanded to more economically employ the baking oven and the rotating carriages as well as to reduce the number of rotating carriers.

SUMMARY OF THE INVENTION

The present invention has the object to provide a coating apparatus which can reduce the number of rotating carriages or carriers required for baking and drying to the least possible number.

In order to achieve the object as described immediately hereinabove, an aspect of the present invention consists of a coating apparatus having a baking area for baking and drying a coat of a paint formed on a substrate and having a carriage for carrying the substrate so arranged as to run on a predetermined conveyor line and as to pass through the baking area; comprising:

a baking oven disposed in the baking area comprising a first baking oven and a second baking oven;

said conveyor line comprising a first conveyor line section and a second conveyor line section, said first conveyor line being so disposed as to pass through said first baking oven and said second conveyor line being so disposed as to pass through said second baking oven;

said carriage for carrying the substrate through said first conveyor line being a carriage having a rotating device so arranged as to rotate the substrate about an approximately horizontal axis;

said carriage for carrying the substrate through said second conveyor line being a carriage without having the rotating device; and a change-over device for changing over the substrate from said carriage to said carriage in a position located subsequent to passage through said first baking oven yet prior to entry into said second baking oven.

The arrangement for the coating apparatus according to the present invention as described hereinabove enables the vehicle body or other coated substrate to be baked and dried while being carried or conveyed with the rotating carrier in the first baking oven, for example, only at an early stage of the baking step in which the rotation of the vehicle body or other coated substrate is required and the partially baked vehicle body or other substrate to be further baked and dried while being carried or conveyed with a usual carrier or carriage in a second baking oven at a later stage of the baking step in which the paint coated does not sag any more even if the vehicle body or other substrate coated therewith would not be rotated.

With this arrangement, the present invention has succeeded in making a coating system as a whole cheaper than such a coating system as so far have been applied by reducing the number of rotating carriers or carriages to pass through the first baking oven by the number that corresponds to the number thereof passing through the second baking oven.

Other objects, features and advantages of the present invention will become apparent in the course of the description of the preferred embodiment, which follows, in conjunction with the accompanying drawings.

DETAILED DESCRIPTION OF THE PREFERRED EMBODIMENTS

Outline of the Coating Method

Figure 1:
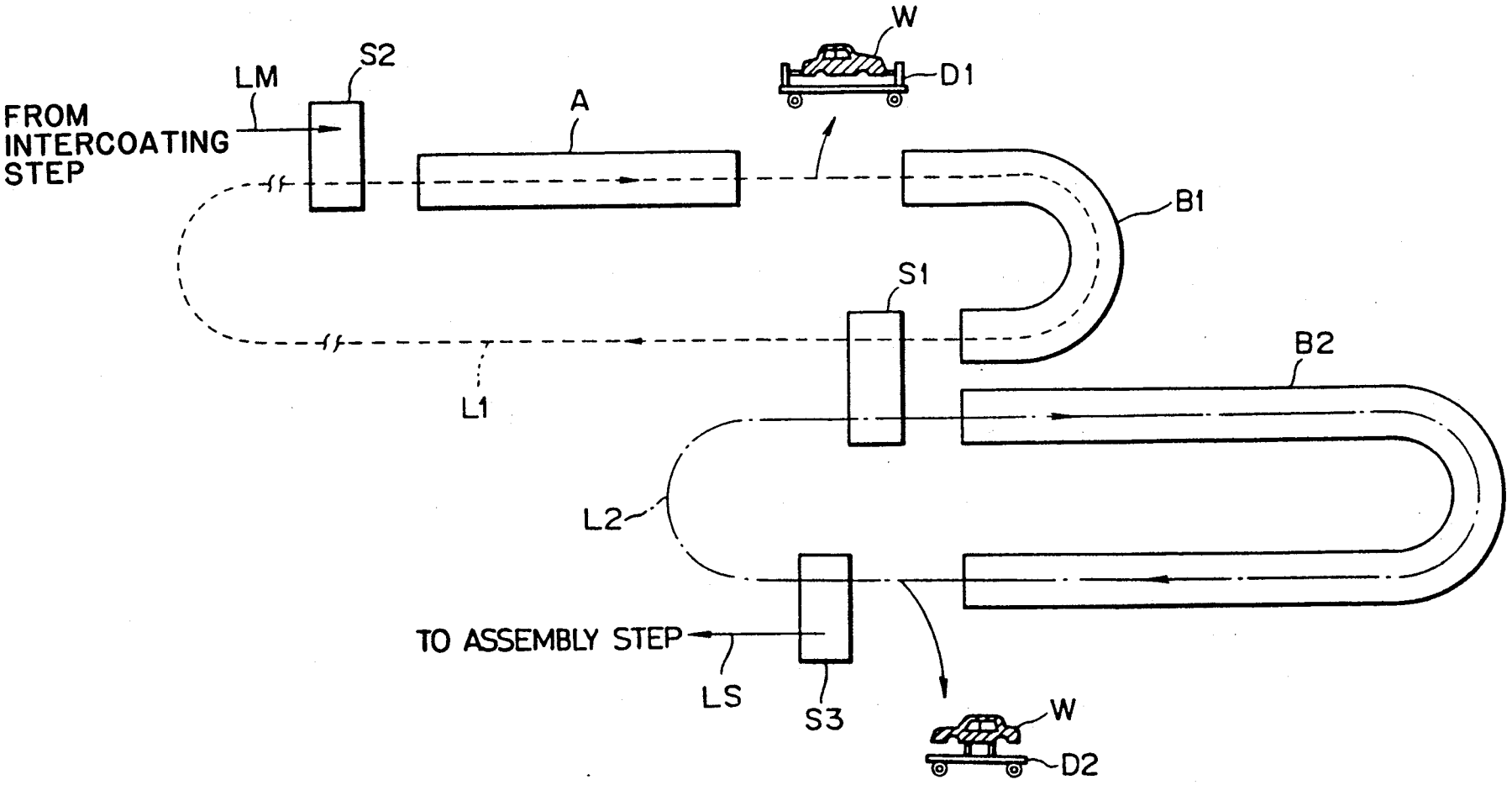
FIG. 1 is a diagrammatic representation illustrating an outline of a whole series of steps according to an embodiment of the present invention.

FIG. 1 shows an outline of the steps of the coating method associated with the coating apparatus according to the present invention, in which reference symbol W denotes a coated vehicle body that is to be baked by the baking apparatus.

As shown in FIG. 1, reference symbol L1 denotes a first conveyor line, as well as a change-over station S2, a coating booth A, a first baking oven B1, and a change-over station S1 are disposed along the first conveyor line L1 in this order in a direction of travel of conveyance. The first conveyor line L1 is disposed of an endless type and a rotating carriage or carrier D1 is operatively conveyed along the first conveyor line L1 in such a manner as will be described hereinafter.

In the change-over station S2, an automotive vehicle body W as a coated substrate is changed over from a conveyor line LM for an intercoating step in which the vehicle body W is coated with an intercoating paint to the first conveyor line L1 where the vehicle body W is loaded on the rotating carrier or carriage D1. After the change-over station S2, the vehicle body W is conveyed with the rotating carriage D1 to the coating booth A where the intercoated vehicle body W is then coated with an overcoating paint in a film thickness thicker than its sagging limit, that is, in a film thickness thicker than a thickness of the overcoating paint that may sag during the baking step which follows if the overcoat would be stayed as it was sprayed thereon. The overcoating may generally be carried out by electrostatic spray coating method. The first baking oven B1 is so set as to have at least a length that corresponds to the period of time during which the overcoated vehicle body W is being baked, while being rotated by the rotating carriage D1, to such an extent that the paint of the overcoat becomes so cured as to cause no sagging any more even if the overcoated vehicle body W would not be rotated any longer. In the embodiment as is described in this specification, the first baking oven B1 is of a type where the vehicle body W or other substrate is radiated with far infrared rays and a thermosetting paint is employed as the overcoating paint. As described hereinabove, the use of the thermosetting paint as the overcoating paint requires the setting step so that, in this embodiment, a distance of the first conveyor line L1 between the coating booth A and the first baking oven B1 is so set as to correspond to the period of time required for the setting time. In other words, the length of the first conveyor line L1 required for the setting step is so set as to agree with a length that is long enough for the rotating carriage or carrier D1 to pass for a period of time required for setting and curing the overcoat to such an extent as being suitable for the baking step which follows. The change-over station S1 is located on the downstream side of the first baking oven B1 at a position of the first conveyor line L1, and the vehicle body W or other substrate is changed over at the change-over station S1 from the first conveyor line L1 to a second conveyor line L2 which is disposed independently and separately from the first conveyor line L1, as shown in FIG. 1.

The second conveyor line L2 is likewise so designed as to be of an endless type and as to pass through a second baking oven B2 which is located on the downstream side of the second conveyor line L2 which in turn is provided with the change-over station S1 which is so disposed as to be associated with the change-over station S1 disposed on the first conveyor line L1, thereby changing over the vehicle body W or other substrate subsequent to the baking oven B1 from the rotating carriage or carrier D1 to a carriage or carrier D2 of a usual type, i.e., with no rotating device built thereon. In this embodiment, the second baking oven B2 is so set as to be longer than the first baking oven B1 and as to be of a conventional type where the vehicle body W or other substrate is further baked and dried by means of warm air.

Referring further to FIG. 1, the vehicle body W or other substrate is conveyed with a carriage or carrier of a usual type, i.e., without any rotating device, to the first conveyor line L1 from the intercoating step in which it is coated or sprayed with an intercoating paint. The vehicle body W or the other substrate is then unloaded from the carriage or carrier (not shown) on the conveyor line LM and then loaded on the rotating carriage or carrier D1 stationed at the change-over station S2 on the first conveyor line L1. The vehicle body W or the other substrate is then conveyed to the coating booth A located on the downstream side of the change-over station S2 on the first conveyor line L1. At the coating booth A, the intercoated vehicle body W or other substrate is then coated or sprayed with an overcoating paint, such as a thermosetting paint as in this embodiment, in such a film thickness as sagging on the intercoat surface unless treated in such a manner as will be described in more detail. After the coating or spraying with the overcoating paint, the vehicle body W or the other substrate is then conveyed over to the first baking oven B1. In this embodiment, however, the thermosetting paint is employed as the overcoating paint so that the setting station is disposed at the position of the first conveyor line L1 between the change-over station S2 and the first baking oven B1. During passage through the setting station, a solvent contained in the overcoat is allowed to evaporate at room temperature or at a temperature higher to some extent than the room temperature and, as a consequence, the overcoat becomes partially cured to such an appropriate extent that the overcoat is allowed to be baked without causing pinholes due to rapid evaporation of the solvent in the overcoat. In the first baking oven B1, the vehicle body W or other substrate is then baked by means of far infrared rays until the overcoat is cured to such an extent to which the paint of the overcoat does not sag or is not caused to sag any more without rotating the vehicle body W or the other substrate by means of the rotating device built on the rotating carriage or carrier D1. While the vehicle body W or the other substrate is conveyed through the first baking oven B1, it is rotated about its approximately horizontal axis extending in a longitudinal direction thereof, thereby preventing the paint of the overcoat from sagging. It is to be noted that the axis of the vehicle body W or the other substrate about which it is to be rotated may be inclined up to approximately 30°, preferably up to approximately 10°, with respect to the horizontally extending axis of the vehicle body W or the other substrate. By baking the overcoat on the vehicle body W or the other substrate in the first baking oven B1 while rotating it in such a manner as described herein, the overcoat is allowed to be cured or set immediately after the baking step within the first baking oven B1 to such an extent that it does not sag or is not caused to sag any more. It is noted, however, that the vehicle body W or other substrate may be rotated in the setting step in accordance with the kind of the overcoating paint used in such a manner as described herein. When the overcoating paint is used which may sag during passage through the setting step, the vehicle body W or the other substrate is required to be rotated in the setting step in such a manner as described herein unless the overcoat is caused to sag.

In order for the overcoat on the vehicle body W or the other substrate to cause no sagging, it is rotated at a rotating speed that is so set to lie between a predetermined lower limit and a predetermined upper limit. The predetermined lower limit of the rotating speed is so set as to be a value at which a site of the overcoat at which sagging is about to occur is allowed to be rotated prior to causing sagging due to gravity at least from a substantially vertical position to a substantially horizontal position. The term "substantially vertical position" referred to herein is intended herein to mean a position or posture of the surface of the vehicle body W or the other substrate on which the overcoat is formed, in which the paint of the overcoat thereon sags or is caused to sag due to gravity. On the other hand, the term "substantially horizontal position" referred to herein is intended herein to have the meaning opposite to the term "substantially vertical position". Hence, this meaning should be understood to contain such a situation that, even if the surface of the vehicle body W does not lie in an approximately vertical position, the surface thereof with the overcoat formed thereon is to be rotated to a position in which the overcoat does not sag or is not caused to sag any more even if the surface thereon with the overcoat formed thereon does not lie in an approximately horizontal position. The upper limit of the rotating speed, on the other hand, is to be a value at which no sags are caused as a result of centrifugal force. The upper limit for the rotating speed is preferably so set to be approximately 380 cm per second or slower at which the vehicle body W or the other substrate may be rotated as measured at a radially outward tip portion thereof. The rotation of the vehicle body W or the other substrate may be carried out continuously or intermittently in one direction or continuously or intermittently in one direction and then in the opposite direction.

When the rotating carrier or carriage D1 is conveyed on the first conveyor line L1 to the change-over station S1, the vehicle body W or the other substrate is then unloaded from the rotating carrier or carriage D1 and loaded on the carriage or carrier D2 of a conventionally usual type which in turn is then conveyed into the second baking oven B2 located on the downstream side of the change-over station S1. The vehicle body W or the other substrate is further baked and dried during passage of the carriage or carrier D2 through the second baking oven B2. After completion of the second baking and drying, the vehicle body W or the substrate is withdrawn from the second baking oven B2 while being conveyed by the carrier or carriage D2 and then transferred from the second conveyor line L2 to an assembly conveyor line LS connected to an assembly step at a change-over station S3 disposed on the downstream side of the second baking oven B2 on the second conveyor line L2.

At the change-over station S3, the vehicle body W or the other substrate is unloaded from the carriage or carrier D2 stationed in the change-over station S3 on the second conveyor line L2 and loaded on another carriage or carrier of a usual type for conveying the vehicle body W or the other substrate to the assembly step of a conventional construction.

Carriage or Carrier of Usual Type

Figure 4:
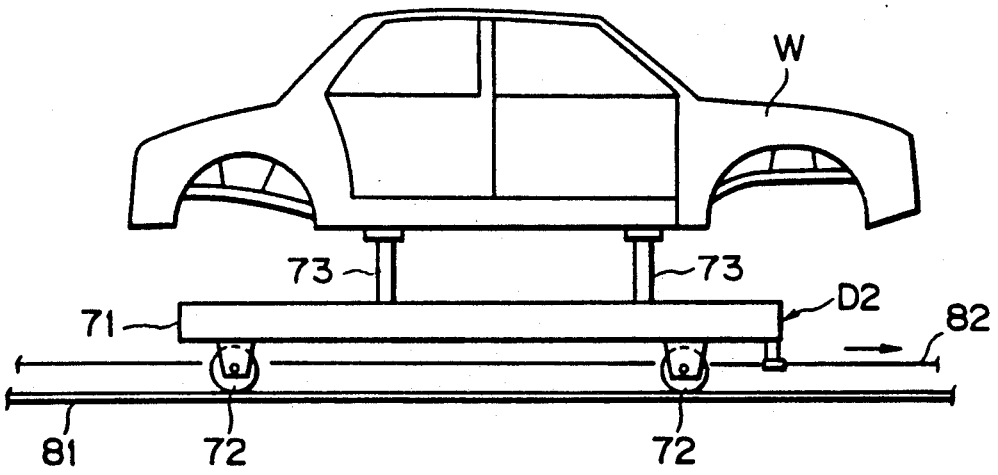
FIG. 4 is a side view of a usual carriage or carrier for conveying a vehicle body or other substrate.

As shown in FIG. 4, the carriage or carrier D2 of a usual type so referred to herein has a construction identical to or similar to those as conventionally used for coating lines of coating automotive vehicle bodies or related parts. Referring to FIG. 4, the carriage or carrier D2 is shown to comprise a base body 71 with wheels 72 so disposed as to run on a rail 81 as the second conveyor line L2. On the base body 71 are so mounted and disposed supports 73 as to stand upright and as to support the vehicle body W or the other substrate thereon at its side sill portions. The carriage or carrier D2 is designed so as to be driven by a chain 82 connected to the base body 71.

Rotating Carriage or Carrier

An example of the rotating carriage or carrier D1 will be described together with a rotation jig mounted on the carriage D1 for rotating the vehicle body W or the other substrate while it is loaded thereon.

First, detailed description will be made of the rotation jig to be used for rotatably supporting the vehicle body W or the other substrate horizontally in a longitudinal direction of the body W or the like.

Figure 5:
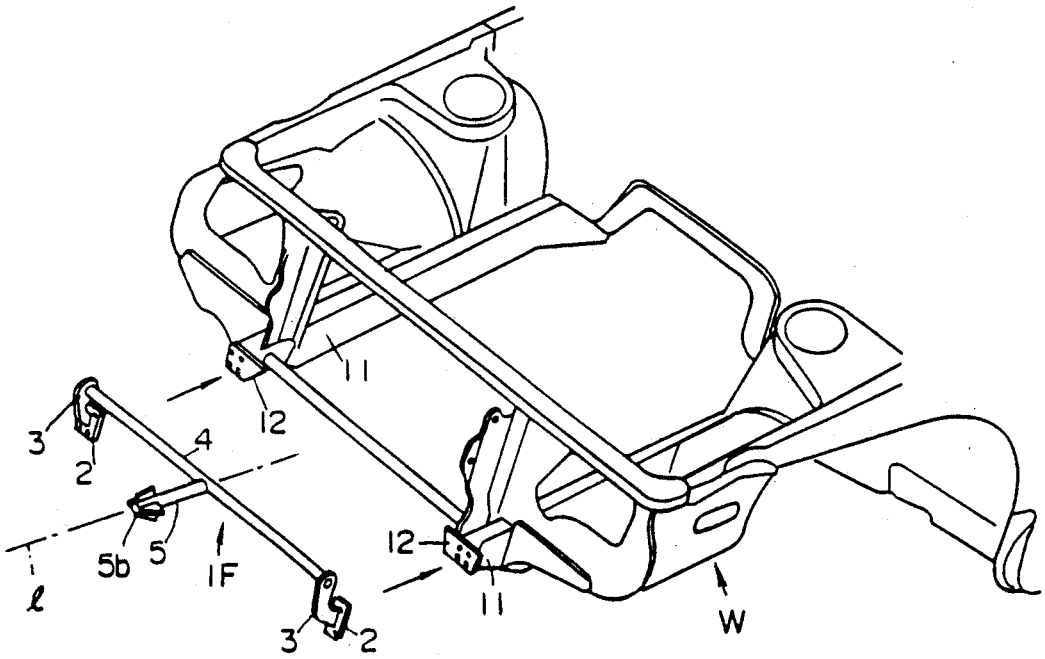
FIGS. 5 and 6 are perspective views illustrating each a jig for rotating the vehicle body.

FIG. 5 shows a front rotation jig portion 1F mounted to the front end portion of the vehicle body W. The front rotation jig portion 1F comprises a pair of left and right mounting brackets 2, 2, a pair of left and right stays 3, 3 welded to the corresponding mounting brackets 2, 2, a connection bar 4 connecting the pair of the stays 3, 3 to each other, and a rotary shaft 5 connected integrally to the connection bar 4. The front rotation jig portion 1F fixes the mounting brackets 2 and 2 to the forward end portion of a front reinforcing member of the vehicle body W such as front side frames 11 and 11. To the front side frames 11 and 11 are usually welded mounting brackets 12 and 12 for mounting a bumper (not shown), so that the mounting brackets 2 and 2 on the side of the vehicle body are detachably fixed with bolts (not shown) to the mounting brackets 12 and 12.

Figure 6:
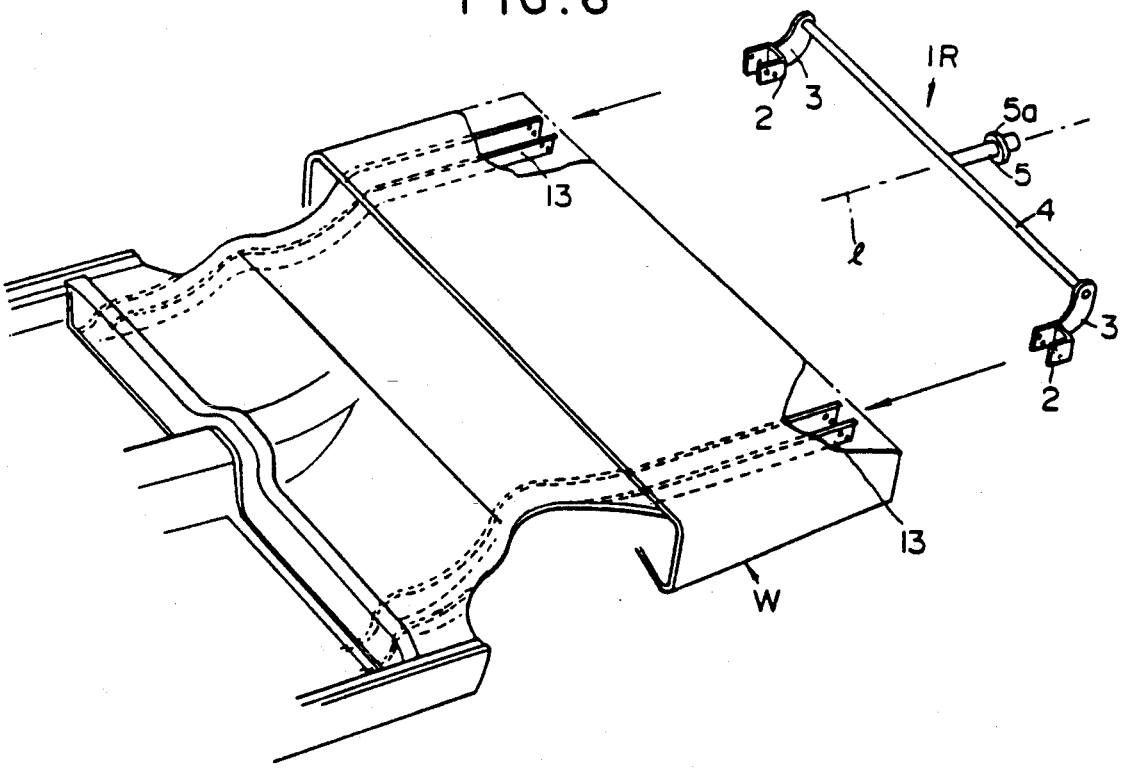

Referring now to FIG. 6, the rear rotation jig portion 1R is shown to have substantially the same construction as the front rotation jig portion 1F. In FIG. 6, the elements of the rear rotation jig portion 1R having the same function are provided with the same reference numerals as the front rotation jig portion 1F, so that duplicate description on those elements will be omitted herefrom for brevity of explanation. The rear rotation jig portion 1R is mounted to the vehicle body W by fixing the mounting brackets 2 and 2 with bolts to floor frames 13 and 13 disposed at the rear end portion of the vehicle body W as a rigidity adding member. To the rear end portion of the floor frame 13 is usually welded in advance mounting brackets for mounting the bumper, so that it is also possible to mount the rear rotation jig portion 1R to the mounting brackets for mounting the bumper.

Figure 7:
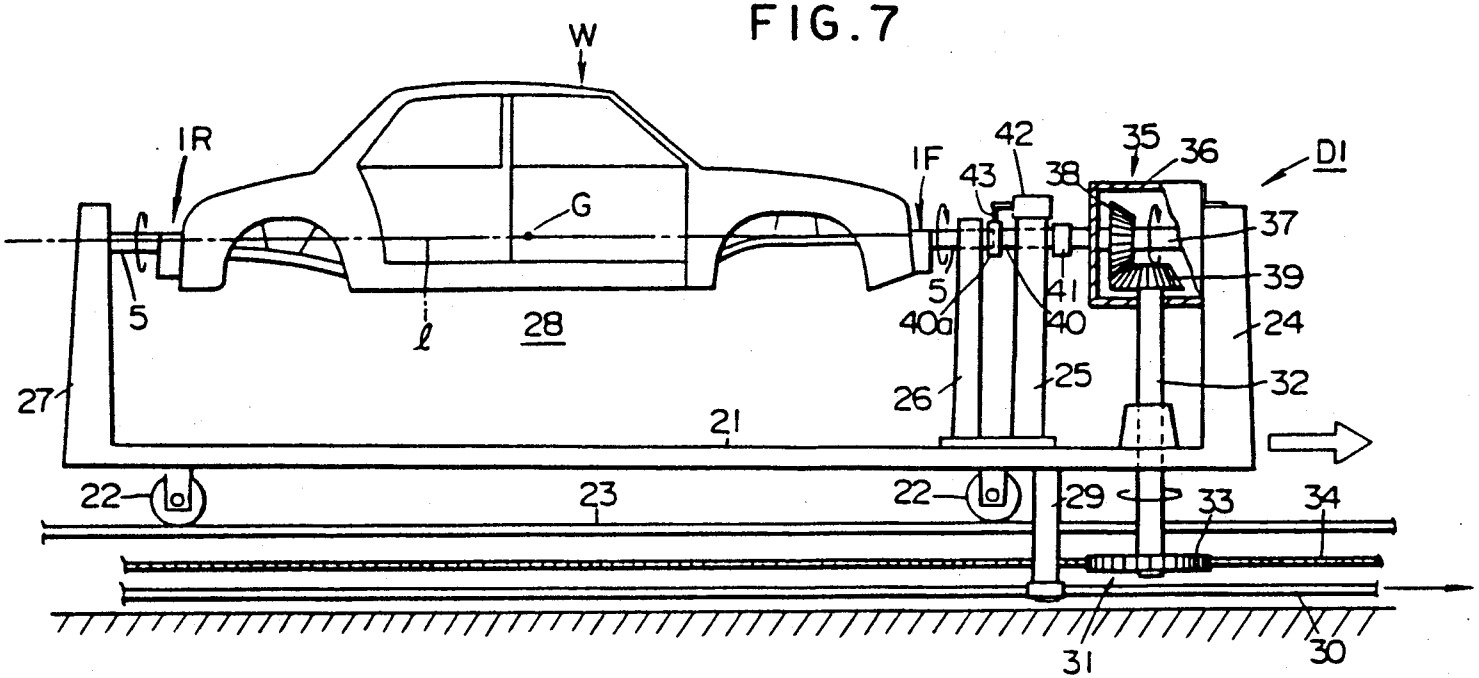
FIG. 7 is a side elevational view illustrating one example of a rotating carriage or carrier for conveying a vehicle body so loaded thereon as to be rotated therewith.
Figure 9:
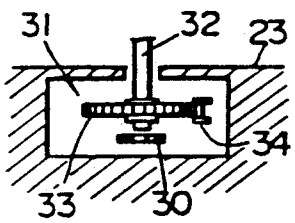
FIG. 9 is a cross sectional view taken along line X9—X9 of FIG. 8.
Figure 8:
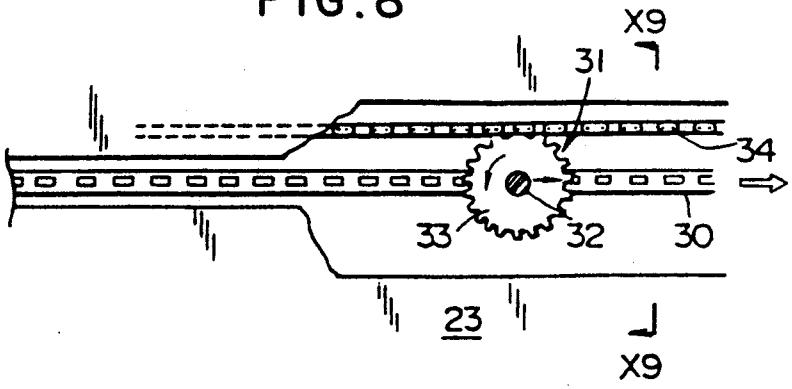
FIG. 8 is a partially cut-out plan view illustrating a mechanism for moving the carriage under passageways.

The front and rear rotation jig portions 1F and 1R are mounted in such a state that their respective rotary shafts 5 and 5 are so disposed as to allow their common rotational axis l to coincide with each other and to lie in a straight line extending in the longitudinal direction of the vehicle body W. It is preferred that the rotational axis l is so designed as to pass through the center of gravity G of the vehicle body W as shown in FIG. 7. This arrangement for the rotational axis serves as preventing a rotating speed of the vehicle from deviating to a large extent, thereby diminishing shocks originating from such deviation. Such shocks may cause sagging of the paint in the coat, so that this arrangement of mounting the front and rear rotation jig portions 1F and 1R is advantageous in prevention of undesirable sags.

The front and rear rotation jig portions 1F and 1R may be prepared for exclusive uses according to kinds of vehicle bodies.

Referring to FIG. 7, the rotating carriage or carrier D1 is shown to comprise a base 21 and wheels 22 mounted to the base 21 with the wheels 22 so arranged as to operatively run on the rail 23. On the base 21 are mounted one front support 24, two intermediate supports 25 and 26, and one rear support 27, each so disposed as to stand upright from the base 21 and as to be arranged in this order from the right to left as shown in FIG. 7, namely, in the direction of travel of the carriage or carrier D1. Between the intermediate supports 25, 26 and the rear support 27 is formed a supporting space 28 extending in a widely spaced relationship in the longitudinal direction of the carriage.

The vehicle body W is loaded on the rotating carrier or carriage D1 and supported in the supporting space 28 in such a manner that the front end portion of the vehicle body W is rotatively supported by the front rotation jig portion 1F to the intermediate support 26 while the rear end portion thereof is rotatively supported likewise by the rear rotation jig portion 1R to the rear support 27.

Figure 10:
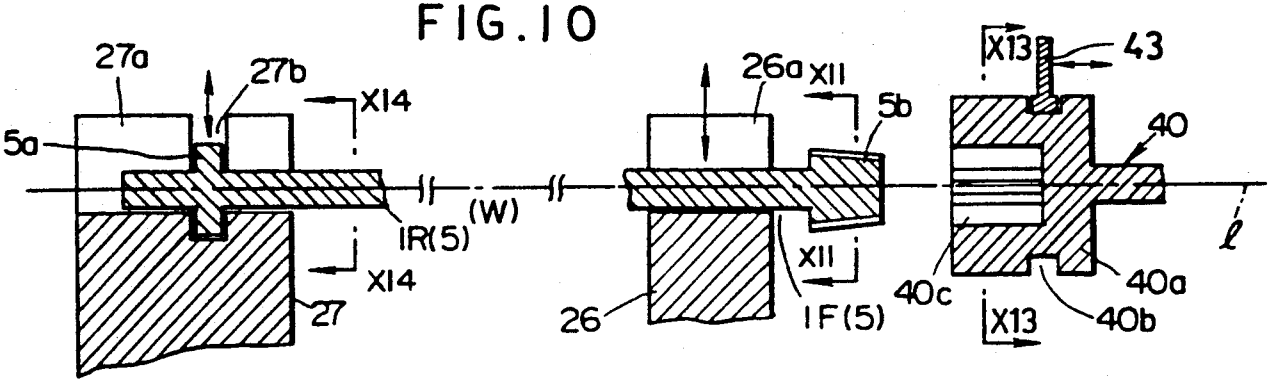
FIG. 10 is a cross sectional side view illustration a connection of a rotational jig with the carriage.
Figure 12:
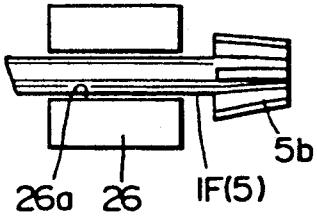
FIG. 12 is a plane view of FIG. 11.
Figure 11:
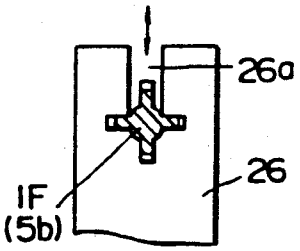
FIG. 11 is a cross sectional view taken along line X11—X11 of FIG. 10.
Figure 15:
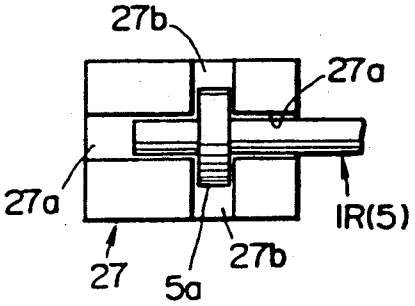
FIG. 15 is a plan view of FIG. 14.
Figure 14:
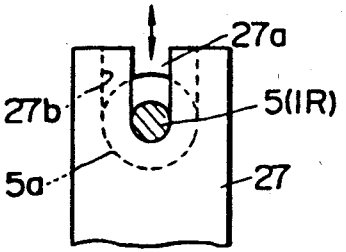
FIG. 14 is a cross sectional view taken along line X14—X14 of FIG. 10.

The front and rear rotary shafts 5 of the respective front and rear rotation jig portions 1F and 1R are connected to the intermediate support 26 and the rear support 27, respectively, so as to be detachable from the vertical direction. The rear rotary shaft 5 of the rear rotation jig 1R is engaged with the rear support 27 so as to be unmovable in the direction of the rotational axis l. At this end, the intermediate support 26 is provided at its top end surface with a cut-out portion 26*a* opening upwards as shown in FIGS. 10, 11 and 12, while the rear support 27 is provided at its top end surface with a cut-out portion 27*a* opening upwards as shown in FIGS. 10, 14 and 15. The cut-out portion 26*a* of the intermediate support 26 is so formed as to have a size large enough to tightly fit the front rotary shaft 5, while the cut-out portion 27*a* of the rear support 27 is so formed as to fit the rear rotary shaft 5. The rear rotary shaft 5 of the rear rotation jig portion 1R is provided with a flange portion 5*a*, and the rear support 27 is provided with a second cut-out portion 27*b* in a shape which is so formed as to correspond to and to be engageable with the flange portion 5*a* of the rear rotary shaft 5R communicating with the first cut-out portion 27*a*. With this construction, the rear rotation jig portion 1R is connected to the first and second cut-out portions 27*a* and 27*b* of the rear support 27 so as to be detachable upwards yet to be unmovable in the longitudinal direction of the vehicle body by means of the stopper action produced by the flange portion 5*a*. The force of rotating the vehicle body W loaded on the carriage or carrier D1 is applied to the vehicle body W through the front rotary shaft 5 of the front rotation jig portion 1F. At this end, the front rotary shaft 5 thereof is provided at its forward end portion with a connection portion 5*b* (see also FIG. 5) as will be described hereinafter.

The base 21 has a stay 29 disposed so as to extend downwards, and a retraction wire 30 is connected to a lower end of the stay 29. The retraction wire 30 is of an endless type which is driven in one direction by a motor (not shown), thereby driving the carriage D1 in the predetermined direction of conveyance. The motor should be disposed in a place that is explosion proof.

In this embodiment, the rotation of the vehicle body W is so designed as to be carried out by using the movement of the carriage or carrier D1, namely, by using the displacement of the carriage or carrier D1 with respect to the rail 23 along which the carriage or carrier D1 runs. At this end, a rotation converting mechanism 31 is provided on the carriage or carrier D1 and/or the conveyor line L2 for converting the displacement of the rotating carriage or carrier D1 into the rotational force for rotating the vehicle body loaded on the carriage D1. The rotation converting mechanism 31 comprises a rotary shaft 32 supported rotatively by the base 21 and extending vertically from the base 21, a sprocket 33 fixed on the lower end portion of the rotary shaft 32, and a chain 34 engaged with the sprocket 33. The chain 34 is so disposed as to lie parallel to the retraction wire 30 and yet as to be unmovable along the rail 23. With this arrangement, as the carriage or carrier D1 is retracted by the retraction wire 25, the sprocket 33 engaged with the unmovably mounted chain 34 rotates the rotary shaft 32, thereby rotating the vehicle body W.

The rotation of the rotary shaft 32 is then transmitted to the front rotary shaft 5 of the front rotation jig portion 1F through a transmitting mechanism 35. The transmitting mechanism 35 comprises a casing 36 fixed on the rear surface of the front support 24, a rotary shaft 37 supported rotatively to the casing 36 and extending in the transverse direction of the carriage, a pair of bevel gears 38 and 39 for rotating the rotary shaft 37 in association with the rotary shaft 32, and a connection shaft 40 connected to the intermediate support 25 rotatively and slidably in the longitudinal direction thereof. The connection shaft 40 is spline-coupled to the rotary shaft 37 in the position indicated by 41 in FIG. 7. This construction permits the rotation of the connection shaft 40 to be carried out in association with the rotation of the rotary shaft 32. The rotary shaft 37 and the connection shaft 40 are arranged so as to allow their rotational axis l to coincide with each other in the longitudinal direction thereof.

Figure 13:
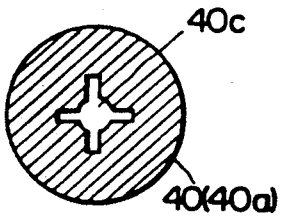
FIG. 13 is a cross sectional view taken along line X13—X13 of FIG. 10.

The connection shaft 40 is detachably connected to the front rotary shaft 5 of the front rotation jig portion 1F. As shown in FIGS. 10 to 12, the front rotary shaft 5 of the front rotation jig portion 1F is provided at its tip portion with a connecting portion **5*b* in a cross shape, while the connection shaft 40 is provided at its rear end portion with a box portion 40*a* having an engaging hollow portion 40*c* formed so as to be tightly engageable with the connecting portion 5*b* of the front rotary shaft 5 as shown in FIGS. 10 and 13. By slidably displacing the connection shaft 40 through a rod 43, for example, by using a hydraulic cylinder 42, the connecting portion 5*b* is allowed to be connected to or disconnected from the engaging hollow portion 40*c* of the box portion 40*a*. When the connecting portion 5*b* is connected to the engaging hollow portion 40*c* of the box portion 40*a*, the connection shaft 40 is rotatable integrally with the rotary shaft 5. The rod 43 is inserted in an annular groove 40*b* formed on the outer periphery of the box portion 40*a*, as shown in FIG. 10, in order to avoid interference with the rotation of the connection shaft 40**.

With the arrangement as described hereinabove, the front and rear rotary shafts 5 and 5 of the respective front and rear rotation jig portions 1F and 1R are allowed to be supported by the intermediate support 26 and the rear support 27 in such a manner as being rotatable but unmovable in the longitudinal directions of the carriage by loading the vehicle body W on the carriage D1 while lowering it to the carriage D1 in such a state that the connection shaft 40 is displaced toward the right in FIG. 7. Thereafter, the connecting portion **5*b* of the rotary shaft 5 of the front rotation jig portion 1F is engaged with the engaging hollow portion 40*c* of the connection shaft 40, whereby the vehicle body W is allowed to rotate about the predetermined rotational axis l by retracting the carriage or carrier D1 by means of the retraction wire 30**.

It is noted herein that the vehicle body W can be unloaded from the rotating carriage or carrier D1 in a way opposite to the manner as described hereinabove.

Change-over Device:

A change-over device to be used at least in the change-over station S1 will be described as an example with reference to FIGS. 2 and 3.

Figure 3:
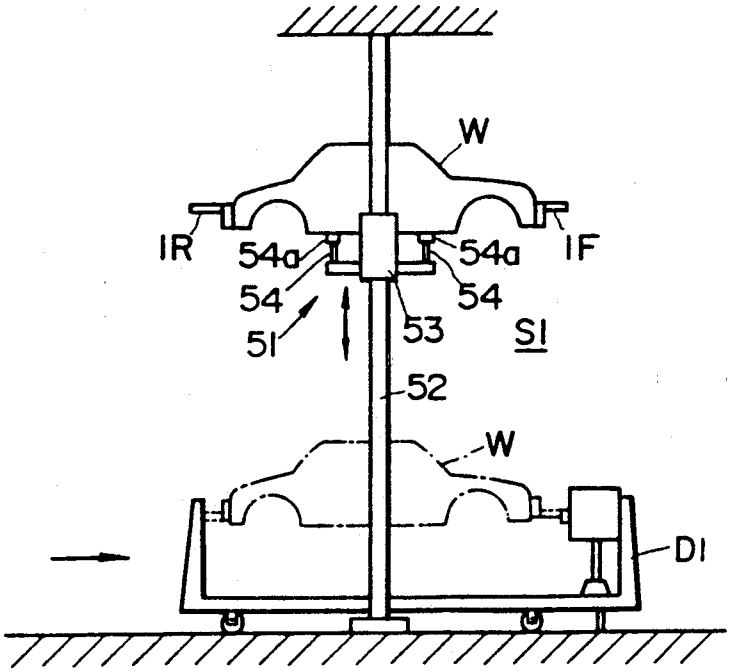
FIG. 3 is a side view of FIG. 2.
Figure 2:
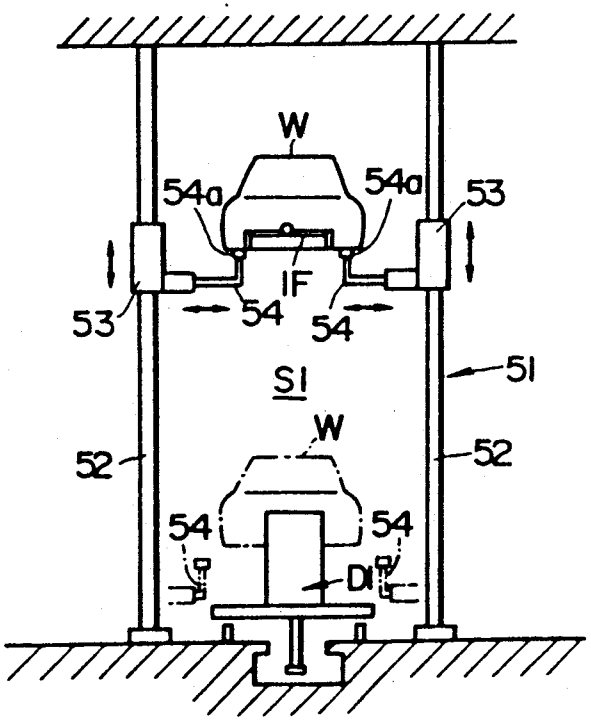
FIG. 2 is a front view showing a change-over device for changing over the vehicle body or other substrate from one carrier to another carrier.

As shown in FIGS. 2 and 3, the change-over device is shown to comprise basically a lifter 51 which includes a pair of left-hand and right-hand guide posts 52, 52 with supporting bases 53 so mounted on the left-hand and right-hand guide posts 52 as to operatively move upwards and downwards. The supporting base 53 is provided with a supporting arm 54 that is driven so as to extend or contract in a horizontal direction of the lifter 51. The supporting arm 54 is provided with a pair of forward and rearward supporting portions **54*a*** in a spaced relationship along the direction of conveyance of the carriage or carrier.

When the carriage or carrier D1 with the vehicle body W loaded thereon is conveyed from the first conveyor line L1 to the change-over station S1 and it is then suspended therein. As the carriage D1 stopped, the supporting arms 54 are extended from the supporting bases 53 located in the lowermost end positions underneath the vehicle body W. The supporting bases 53 are then raised so as to allow supporting members **54*a* of the supporting arms 54 to support the floor frame or side sill portions of the vehicle body W and further moved upwards to raise the vehicle body W from the carriage or carrier D1 upwards and to unload the vehicle body W therefrom. The vehicle body W is further raised to the position high enough for the carriage or carrier D1 to be evacuated from the lifter 51 in the change-over station S1, as shown by the solid lines in FIGS. 2 and 3. Thereafter, another carriage D2 is allowed to enter into a predetermined position on the second conveyor line L2 in the change-over station S1 for loading the vehicle body W currently held by the supporting arms 54. As the new carriage D1 stopped in the change-over station S1, the supporting base 53 is then lowered to unload the vehicle body W from the supporting arms 54 and reload it on the carriage or carrier D2. The supporting arms 54 are then lowered to a lower position and then contracted to the positions closer to the supporting bases 53, as shown by the broken lines in FIGS. 2 and 3, in order not to interfere with the movement of the carriage or carrier D2 and with entry of another carriage or carrier D1** which carries another vehicle body W for unloading.

It is preferred that the carriage or carrier D1 or D2 is fixed in the predetermined position by clamping it from four directions forward and rearward as well as left-hand and right-hand, by means of a position regulating apparatus or the like, so as to be unmovable while the vehicle body W is being loaded or unloaded.

The change-over device may have hangers so disposed at its upper position as to be movable intermittently in a position high enough over the carriage or carrier D1 or D2 in order to cause interference with the movement of the carriage or carrier D1 or D2. In this case, the vehicle body W may be shifted from the lifter 51 to the hanger, and the hanger then conveys the vehicle body W to a new lifter 51. The vehicle body W is then changed over from the hanger to the new lifter, thereby unloading the vehicle body from the old carriage or carrier D1 or D2 and then reloading it on the new carriage or carrier D1 or D2.

The change-over device having the structure as described hereinabove may be likewise employed for the change-over stations S2 and S3.

First Baking Oven

Figure 16:
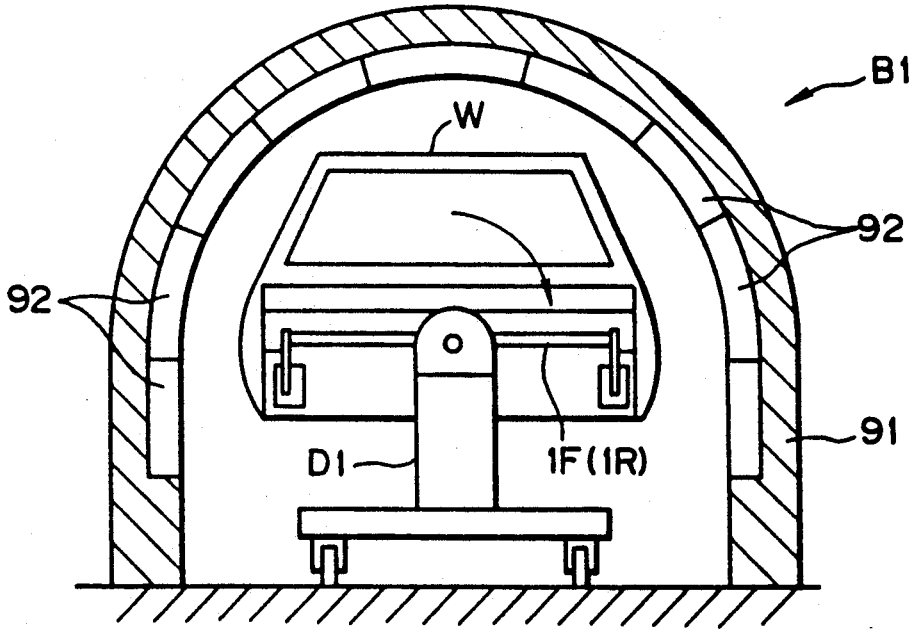
FIG. 16 is a front view showing an example of the first drying or baking oven.

FIG. 16 illustrates an example of the first baking oven B1 to be used for the coating apparatus according to the present invention.

The first baking oven B1 comprises a main body 91 defining and surrounding a tunnel having a size large enough to allow the rotating carriage or carrier D1 to pass through the tunnel. The tunnel of the main body 91 is provided on its inner wall with a plurality of panels 92 which radiate far infrared rays. As the electric power is applied to the far infrared rays panels 92, the tunnel is warmed to a predetermined temperature. It is to be noted herein that the first baking oven B1 may be of a type in which hot air is blown, however, the baking oven of far infrared rays type is advantageous over the one of the hot air type, in that no air is circulated by conviction, thereby causing no dirt to float within the tunnel and to adhere to the surface of the overcoat while the vehicle body is conveyed through the first baking oven B1 by the carrier or carriage D1. Particularly, dirt resulting from sags of the paint is likely to be produced by blowing hot air to the overcoat on the vehicle body W in such a state that the paint is deposited on the vehicle body W in such a film thickness thicker than its sagging limit. Further, the advantage to be produced by using far infrared rays resides in the fact that the paint in the overcoat can be warmed from its inside, i.e., from the plate panel side of the vehicle body, thereby allowing the solvent in the paint to be effectively evaporated. Examples of Conditions for Coating and Drying A. Coating Conditions:

(1) Undercoating:
Cationic electrodeposition;
Baking: 170° C., 30 minutes;
Film thickness: 20 μm (2) Intercoating:
a. Paint: Thermosetting-type oil-free polyester (gray)
b. Viscosity: 0.6 poise
c. Coater:
Minibell (bell size: 60 mm)
No. of revolutions: 22,000 rpm
Voltage: −90 kV
Shaping air pressure: 3.0 kg/cm$^2$
Distance from gun: 30 cm
d. Drying conditions:
Setting (7 minutes at room temp)
Baking (140° C.×25 minutes)

(3) Overcoating:
a. Paint: Thermosetting-type acryl melamine paint (black)
b. Viscosity: 0.6 poise
c. Unvolatilizable ingredients: 42% by weight (0.6 poise)
d. Solvents:
Toluene, 50% by weight
Solvesso 100, 50% by weight
e. Sag preventing agent: Cross-linked acryl resin powders (6% by weight based on unvolatilizable ingredients)
f. Coater:
Minibell (bell size: 60 mm; Nippon Lundsberg)
No. of revolutions of minibell: 16,000 rpm
Shaping pressure: 3 kg/cm$^2$
Voltage: −90 kV
Distance from gun: 30 cm
Interval between two coatings: 5 min.

B. Drying Conditions:

(1) Setting step:
a. Atmospheric temperature at the time of the start of setting: 20° C. plus or minus 2° C.
b. Time for setting: 10 minutes (2) First drying step (oven of type radiating far infrared rays):
a. Atmospheric temperature within oven: 120° C.
b. Time for raising temperature: 7 minutes (substrate raised from 20° C. to 140° C.)
c. Drying time: 10 minutes (7 minutes for raising the substrate from 20° C. to 140° C. and 3 minutes for retaining the substrate at 140° C.)

(3) First drying step (oven of type blowing hot air):
a. Atmospheric temperature within oven: 150° C.
b. Time for raising temperature: 15 minutes (substrate raised from 20° C. to 140° C.)
c. Drying time: 20 minutes (15 minutes for raising the substrate from 20° C. to 140° C. and 5 minutes for retaining the substrate at 140° C.)

(4) Second drying step (oven of type blowing hot air):
a. Atmospheric temperature within oven: 150° C.
b. Time for raising temperature: 15 minutes (substrate raised from 20° C. to 140° C.)
c. Drying time: 25 minutes Although the present invention has been described in connection with the preferred embodiments thereof with reference to the accompanying drawings which are used only for the purpose of illustration, not limitation, those skilled in the art will readily conceive numerous changes and modifications within the framework of obviousness upon the reading of the specification presented herein of the present invention. Accordingly, such changes and modifications are, unless they depart from the spirit and scope of the present invention as delivered from the claims annexed hereto, to be construed as included therein.

What is claimed is:

1. A coating apparatus having a baking means for baking and drying a coat of paint formed on a substrate and having first and second carriages for carrying the substrate on a predetermined conveyor line which passes through the baking means, the baking means comprising a first baking oven and a second baking oven;

said conveyor line comprising a first conveyor line section and a second conveyor line section, said first conveyor line section being so disposed as to pass through said first baking oven and said second conveyor line section being so disposed as to pass through said second baking oven;

said first carriage being supported only on said first conveyor line section and comprising a rotating means for rotating the substrate about an approximately horizontal axis;

said second carriage being supported only on said second conveyor line section and having means for supporting the substrate fixed relative to said second carriage; and a transfer device for transferring the substrate from said first carriage to said second carriage in a position located between said first baking oven and said second baking oven.

2. A coating apparatus as claimed in claim 1, wherein said first baking oven includes means for radiating infrared rays onto said substrate.

3. A coating apparatus as claimed in claim 1, wherein said first baking oven includes means for blowing hot air.

4. A coating apparatus as claimed in claim 1, wherein said second baking oven includes means for blowing hot air.

5. A coating apparatus as claimed in claim 1, wherein said rotating device comprises:

a supporting means for rotatably supporting the substrate;

a conversion means for converting linear displacement of said first carriage into rotational displacement; and a transmission means for transmitting the rotational displacement converted by said conversion means to the substrate supported rotatably by said support means.

6. A coating apparatus as claimed in claim 5, wherein said conversion means comprises:

a toothed rotary body mounted rotatably to the carriage; and a toothed long-length body disposed along said first conveyor line and engageable with said toothed rotary body.

7. A coating apparatus as claimed in claim 1, including means for supporting a vehicle body for rotation about an approximately horizontal axis.

8. A coating apparatus as claimed in claim 1, wherein said first conveyor line section is an endless conveyor and said second conveyor line section is an endless conveyor.

9. A coating apparatus having a spraying means for spraying a substrate with a paint, a baking means for baking and drying a coat formed by spraying the paint on the substrate, and having first and second carriages for carrying the substrate on a predetermined conveyor line which passes adjacent the spraying means and through the baking means, the baking means comprising a first baking oven and a second baking oven;

said conveyor line comprising a first conveyor line section and a second conveyor line section, said first conveyor line section being so disposed as to pass adjacent said spraying means and through said first baking oven and said second conveyor line section being so disposed as to pass through said second baking oven;

said first carriage carrying the substrate through said first conveyor line section and comprising a rotating means for rotating the substrate about an approximately horizontal axis;

said second carriage carrying the substrate through said second conveyor line section and having means for supporting the substrate fixed relative to said second carriage; and a transfer device for transferring the substrate from said first carriage to said second carriage in a position located between said first baking oven and said second baking oven.

10. A coating apparatus as claimed in claim 9, wherein said first baking oven includes means for radiating infrared rays onto said substrate.

11. A coating apparatus as claimed in claim 9, wherein said first baking oven includes means for blowing hot air.

12. A coating apparatus as claimed in claim 9, wherein said second baking oven includes means for blowing hot air.

13. A coating apparatus as claimed in claim 9, wherein said rotating device comprises:

a support means for rotatably supporting the substrate;

a conversion means for converting linear displacement of said first carriage in the direction of conveyance into rotational displacement; and a transmission means for transmitting the rotational displacement converted by said conversion means to the substrate supported rotatably by said support means.

14. A coating apparatus as claimed in claim 13, wherein said conversion means comprises:

a toothed rotary body mounted rotatably to the carriage; and a toothed long-length body disposed along said first conveyor line and engageable with said toothed rotary body.

15. A coating apparatus as claimed in claim 9, including means for supporting a vehicle body for rotation about a horizontal axis.

16. A coating apparatus as claimed in claim 15, wherein said approximately horizontal axis about which the vehicle body is rotated extends in a longitudinal direction of the vehicle body.

17. A coating apparatus as claimed in claim 15, wherein said approximately horizontal axis about which the vehicle body is rotated is so disposed as to approximately pass through the center of gravity of the vehicle body.

18. A coating apparatus as claimed in claim 9, said spraying means comprises means for applying an overcoating.

19. A coating apparatus as claimed in claim 9, said spraying means comprises an electrostatic sprayer for spraying paint.

20. A coating apparatus as claimed in claim 9, wherein said first conveyor line section is a first endless conveyor and said second conveyor line section is a second endless conveyor.

21. A coating apparatus as claimed in claim 9, wherein said spraying means is spaced from said baking means to permit substantial setting of said paint before entering said baking means.

* * * * *